US012037905B2

(12) United States Patent
Wang et al.

(10) Patent No.: US 12,037,905 B2
(45) Date of Patent: Jul. 16, 2024

(54) METHOD OF NO-PILLAR MINING WITH GOB-ENTRY RETAINING ADAPTED FOR FULLY-MECHANIZED TOP COAL CAVING IN THICK COAL SEAM

(71) Applicant: China University of Mining and Technology, Beijing, Beijing (CN)

(72) Inventors: Jiong Wang, Beijing (CN); Manchao He, Beijing (CN); Guangyuan Yu, Beijing (CN); Han Sun, Beijing (CN)

(73) Assignee: China University of Mining and Technology, Beijing, Beijing (CN)

( * ) Notice: Subject to any disclaimer, the term of this patent is extended or adjusted under 35 U.S.C. 154(b) by 130 days.

(21) Appl. No.: 17/604,113

(22) PCT Filed: Apr. 15, 2020

(86) PCT No.: PCT/CN2020/084946
§ 371 (c)(1),
(2) Date: May 19, 2022

(87) PCT Pub. No.: WO2020/211784
PCT Pub. Date: Oct. 22, 2020

(65) Prior Publication Data

US 2022/0275726 A1 Sep. 1, 2022

(30) Foreign Application Priority Data

Apr. 16, 2019 (CN) ..... 201910305280.X

(51) Int. Cl.
*E21D 19/02* (2006.01)
*E21C 37/00* (2006.01)
(Continued)

(52) U.S. Cl.
CPC ..... *E21D 19/02* (2013.01); *E21C 37/00* (2013.01); *E21C 41/18* (2013.01); *E21D 20/02* (2013.01)

(58) Field of Classification Search
CPC ..... E21D 19/02; E21D 20/02; E21C 37/00; E21C 41/18
See application file for complete search history.

(56) References Cited

U.S. PATENT DOCUMENTS 4,094,153 A * 6/1978 Blumenthal ..... E21D 23/0454 405/297
4,189,257 A * 2/1980 Nakajima ..... E21D 23/03 405/291
(Continued)

FOREIGN PATENT DOCUMENTS

CN 1257846 A 6/2000
CN 101122235 A 2/2008
(Continued)

OTHER PUBLICATIONS

International Search Report regarding PCT/CN2020/084946, Jun. 29, 2020, China National Intellectual Property Administration.
(Continued)

*Primary Examiner* — Janine M Kreck
(74) *Attorney, Agent, or Firm* — Sisson & Banyas, Attorneys at law, LLC; Jeffrey J. Banyas

(57) ABSTRACT

The present disclosure relates to a technical field of coal mining, particularly to a method of no-pillar mining with gob-entry retaining adapted for fully-mechanized top coal caving in a thick coal seam, which comprises the following steps: reinforcing support on a roof and two sides of a roadway; performing roof slitting blasting to form a pre-splitting slit; erecting a temporary support device and a gangue retaining device in the roadway along the retained entry; performing no caving within a range of a preset
(Continued)

distance at an end of the working face near the retained entry side; and removing the temporary support device in the roadway after entry forming stabilizes, and closing the goaf to complete entry retaining. The roof slitting blasting is more beneficial to collapse of strata in the goaf, so that the strata in the slit can better fill stoping space after collapse, and the roof of the retained entry forms a short arm beam structure laterally, which avoids forming a long suspended roof in the goaf, and improves the stress of surrounding rock of gob-side entry retaining; coal caving is not performed in a certain range at the end of the working face of the retained entry side, which further ensures the filling effect of the goaf on the retained entry side, effectively limits the rotary sinking of blocks of the main roof, and greatly reduces effect on the stability of the retained entry.

9 Claims, 7 Drawing Sheets

(51) Int. Cl.
*E21C 41/18* (2006.01)
*E21D 20/02* (2006.01)

(56) References Cited

U.S. PATENT DOCUMENTS

| | | | | |
|---|---|---|---|---|
| 10,443,380 | B2 * | 10/2019 | Fan | E21D 11/155 |
| 11,008,860 | B2 * | 5/2021 | He | E21D 15/00 |
| 2013/0187436 | A1 | 7/2013 | Wang | |
| 2018/0187547 | A1 | 7/2018 | He | |
| 2018/0195387 | A1 | 7/2018 | He | |
| 2023/0063143 | A1 | 3/2023 | Wang | |

FOREIGN PATENT DOCUMENTS

| | | | |
|---|---|---|---|
| CN | 102536239 | A | 7/2012 |
| CN | 102966354 | A | 3/2013 |
| CN | 103195426 | A | 7/2013 |
| CN | 103233740 | A | 8/2013 |
| CN | 105507951 | A | 4/2016 |
| CN | 107191208 | A | 9/2017 |
| CN | 107862106 | A | 3/2018 |
| CN | 108643907 | A | 10/2018 |
| CN | 108678769 | A | 10/2018 |
| CN | 109098714 | A | 12/2018 |
| CN | 109538210 | A | 3/2019 |
| CN | 109973126 | A | 7/2019 |
| CN | 110206542 | A | 9/2019 |

OTHER PUBLICATIONS

Feng, f4 Technology fsft4IRm, 2017 No. 28, Science and Technology Innovation Herald, DOI: 10.16660/j.cnki.1674-098X.2017.28.028, ENOTC-Atk-OAtOE None ISt-i.

High, Yang, Tom, Zhu Zhen, Rock and Soil Mechanics, vol. 39 No. 1, Jan. 2018, Zicheng Lane Engineering Test.

Guofeng, He Manchao, Research on mining technology of ig fp va empty-oJ top roadway without coal in Baijiao Mine, vol. 28 No. 441, Mining and Safety ifi'44-Report, vol. 28 No. 4, Dec. 2011, Journal of Mining 6, Safety Engineering, Dec. 2011.

Ke-xue Zhang, Yao-dong Jiang and Zheng-bin Zhang, Determining the reasonable width of narrow pillar of roadway in gob entry driving in the large pillar, Journal of Mining & Safety Engineering, Mar. 2014, vol. 31, No. 2, 255-262.

* cited by examiner

METHOD OF NO-PILLAR MINING WITH GOB-ENTRY RETAINING ADAPTED FOR FULLY-MECHANIZED TOP COAL CAVING IN THICK COAL SEAM

PRIORITIES AND CROSS REFERENCES

This application claims priority from International Application No. PCT/CN2020/084946 filed on 15 Apr. 2020, and Chinese Patent Application No. 201910305280.X filed on 16 Apr. 2019 the teachings of each of which are incorporated by reference herein in their entirety.

FIELD

The present disclosure relates to a technical field of coal mining, particularly to a method of no-pillar mining with gob-entry retaining adapted for fully-mechanized top coal caving in a thick coal seam.

BACKGROUND

Coal is a primary energy source in China, which is abundant in reserves. Among coal reserves that are ascertained in China, reserves of the thick coal seam are 44%, which is a resource advantage of China. A fully-mechanized top coal caving technology for a thick coal seam has become an important development direction of thick coal seam mining technology in China due to its safety, efficiency, and low cost. However, due to a large mining height of the thick coal seam, space of a gob is large after coal seam mining, and an activity range of stope roof cover rock resulting from the large mining height increases, which are prone to cause an excessive overhanging area, result in a large stope pressure, and make it difficult to maintain a gob-side entry especially under hard roof conditions. Meanwhile, due to insufficient release of top coal, it is prone to result in residual coal within the gob and to result in a series of safety issues such as fire and spontaneous combustion of the empty area. The current top coal caving in a thick coal seam often uses an established pillar to support the roof and meanwhile close the gob. This method suffers from a number of adverse conditions: if the established pillar is too small, the coal pillar is difficult to support stope roof pressure and is easy to cause a strictly controlled roadway to be crushed; if the established pillar is too large, although it can support the stope roof pressure, it will waste a large number of coal resources which cannot be stopped, resulting in resource loss and waste, and the established pillar will cause severe disasters such as outburst of coal and gas and rock burst, resulting in equipment damage and huge casualties, which has huge safety hazard.

The no-pillar mining with gob-entry retaining technology refers to technology of reinforcing support on a stoping roadway, then performing oriented pre-splitting blasting on a side where a roadway is to form a gob, slitting the roof at a designed position, with stoping of a working face coal seam after the slitting is finished, forming a roadway side when the gob roof collapses along the pre-splitting slit under the action of mine pressure, and using partial space of the original roadway and support to automatically form a new roadway as a stoping roadway of the next working face. By using technical means such as pre-splitting blasting, constant resistance anchor cable reinforcing support, and gangue retaining behind a mining support, the no-pillar mining with gob-entry retaining technology reduces pressure of the stope roof on the roadway, eliminates section coal pillars, increases a resource recovery rate, tunnels one less gateway, reduces a drivage ratio per 10,000 tons, has good application prospects, and has become mainstream trends in technical development of coal industry.

However, the current no-pillar mining with gob-entry retaining technology is mainly applied to coal seams having a thickness of no greater than 4 m, and with the development of technology in recent years, the no-pillar mining with gob-entry retaining technology is gradually applied to thick coal seams, but the above thick coal seams employ general fully-mechanized mining technology, and report on no-pillar mining with gob-entry retaining technology under conditions of top coal caving in a thick coal seam has never been seen. Under the conditions of top coal caving in a thick coal seam, if conventional medium-thick coal seam gob-side entry retaining is employed, there is a need for the anchor cable length used when supporting the roadway roof to be about 3 times the mining height, the fully-mechanized mining thickness of the thick coal seam is 8 m to 15 m or more, and the required anchor cable length is around 30 m, which cannot be achieved in the prior art. Under the conditions of top coal caving in a thick coal seam, top coal and an immediate roof at a gob side behind the working face are broken along the edge of a roadside filling body under the action of early support resistance of the roadside filling body and strata self-weight. At this stage, blocks of a main roof performs rotary sinking with collapse of the immediate roof, which has a great impact on stability of a retained entry, especially for top coal caving of the thick coal seam, an activity range of the stope roof is increased, and the top coal is continuously released, which disturbs the roof of the retained entry more severely; since the coal seam is thick, the roof of the retained entry is often coal, which is lower in strength and looser than rock, and is easier to break and lose stability under the action of a plurality of times of disturbance. Therefore, the rotary movement of the main roof block above the gob-side retained entry under conditions of fully mechanized top coal caving of the thick coal seam has a greater impact on the stability of the retained entry.

SUMMARY

In order to solve the above technical problems, the present disclosure provides the following technical solutions.

The present disclosure provides a method of no-pillar mining with gob-entry retaining adapted for fully-mechanized top coal caving in a thick coal seam. The method comprises the following steps:

- reinforcing support on a roof and two sides of a roadway during tunnelling of a retained entry;
- performing roof slitting blasting in advance of a working face, with blast holes arranged in a stoping-side roadway corner line area to form a pre-splitting slit;
- erecting a temporary support device and a gangue retaining device in the roadway along the retained entry;
- performing no caving within a preset distance X at an end of the working face near the retained entry side in the stoping process of the working face, wherein a calculation formula of the preset distance X is $$X = H_{slit} \cdot \sin\theta + \frac{mA}{2\tan\varphi_0}\ln\left[\frac{K\gamma H + \frac{c_0}{\tan\varphi_0}}{\frac{c_0}{\tan\varphi_0} + \frac{p_z}{A}}\right]$$

wherein $H_{slit}$ is slitting depth in units of m,

θ is an angle between a slitting line and a vertical direction in units of °, m is a coal seam thickness in units of m, A is a side pressure coefficient, $\varphi_0$ is an internal friction angle at a coal seam interface in units of °, $c_0$ is a cohesive force at the coal seam interface in units of MPa, K is a stress concentration coefficient, γ is an average volume weight of overlying strata in units of $N/m^3$;

H is a roadway burial depth in units of m, and $P_z$ is a support resistance of a coal side on the roadway stoping side in units of MPa; and removing the temporary support device in the roadway after stoping at the working face and entry forming stabilizes, and closing the gob to complete entry retaining.

Further, the gangue retaining device comprises a gangue retaining pillar, a double layer metal mesh, and a flexible mold bag. The double layer metal mesh is fixed to one side of the gangue retaining pillar near the gob, and the flexible mold bag is laid within the double layer metal mesh. After entry forming stabilizes, the flexible mold bag is filled with a high water material to close the gob.

Further, the gangue retaining pillar comprises two yieldably overlapping upper and lower U-shaped steels, the two U-shaped steels are connected by two flanges, the U-shaped steels are arranged at 500 mm intervals along a roadway direction and embedded in a bottom plate by no less than 200 mm.

Further, in a step of reinforcing support of the roof and two sides of the roadway, a constant resistance anchor cable and a grouting anchor cable are used to reinforce support on the roof, a common anchor cable is used to reinforce support on a main side, and a grouting anchor cable and a common anchor cable are used to reinforce support on the auxiliary side.

Further, before the secondary reuse of the retained entry, a grouting anchor cable is used to grout the cracked roof and auxiliary side, so as to improve strength of the roof and auxiliary side coal.

Further, the blast holes are deflected to the gob by 10° to 20°, a depth of the blast holes is 10 m to 14 m, a distance between the blast holes is 450 mm to 550 mm, and a distance between the blast hole and the roadway main side is 150 mm to 250 mm.

Further, a lute length of the blast hole is no less than 3 m, a number of explosive rolls in the blast hole gradually decreases from inside to outside, and the explosive roll is not placed in a shaped charge pipe next to the lute.

Further, a step of erecting the temporary support device in the roadway along the retained entry comprises: supporting with double-row unit brackets in a range of 50 m in front of the working surface, and a retreat space of 2 m is reserved between the unit brackets. Single-row unit brackets and single sheds are used jointly for support in a range of 250 m behind a mining support, a row of unit brackets is arranged on a pre-splitting slit side, and two rows of single sheds are arranged on the non-slitting side.

Further, a step of erecting the temporary support device in the roadway along the retained entry also comprises: Single-row unit brackets and single sheds are used jointly for support in a range of 250 m behind a mining support, a row of unit brackets is arranged on a pre-splitting slit side, and two rows of single sheds are arranged on the non-slitting side.

Compared with the prior art, the above technical solution provided in the examples of the present disclosure has the following advantages: slitting blasting of the roadway roof is more beneficial to collapse of strata in the gob, so that the strata in the slit can better fill stoping space after collapse, and the roof of the retained entry forms a short arm beam structure laterally, which avoids forming a long suspended roof in the gob, and improves the stress of surrounding rock of gob-side entry retaining, that is, reduces additional load brought to the retained entry; coal caving is not carried out in a certain range at the end of the working face of the retained entry side, which further ensures the filling effect of the gob on the retained entry side, and a formula for calculating an effective range of no coal caving is given, which effectively limits the rotary sinking of blocks of the main roof and greatly reduces effect on the stability of the retained entry.

BRIEF DESCRIPTION OF THE DRAWINGS

The drawings herein are incorporated into the specification and constitute a part of the specification. The drawings show examples conforming to the present disclosure and are used together with the specification to explain the principle of the present disclosure.

In order to explain the technical solutions more clearly in the examples of the present disclosure or the prior art, the drawings used in the examples or the description of the prior art are briefly explained. Obviously, one skilled in the art can obtain other drawings based on these drawings without involving creative efforts.

IN THE DRAWINGS

Figure 1:
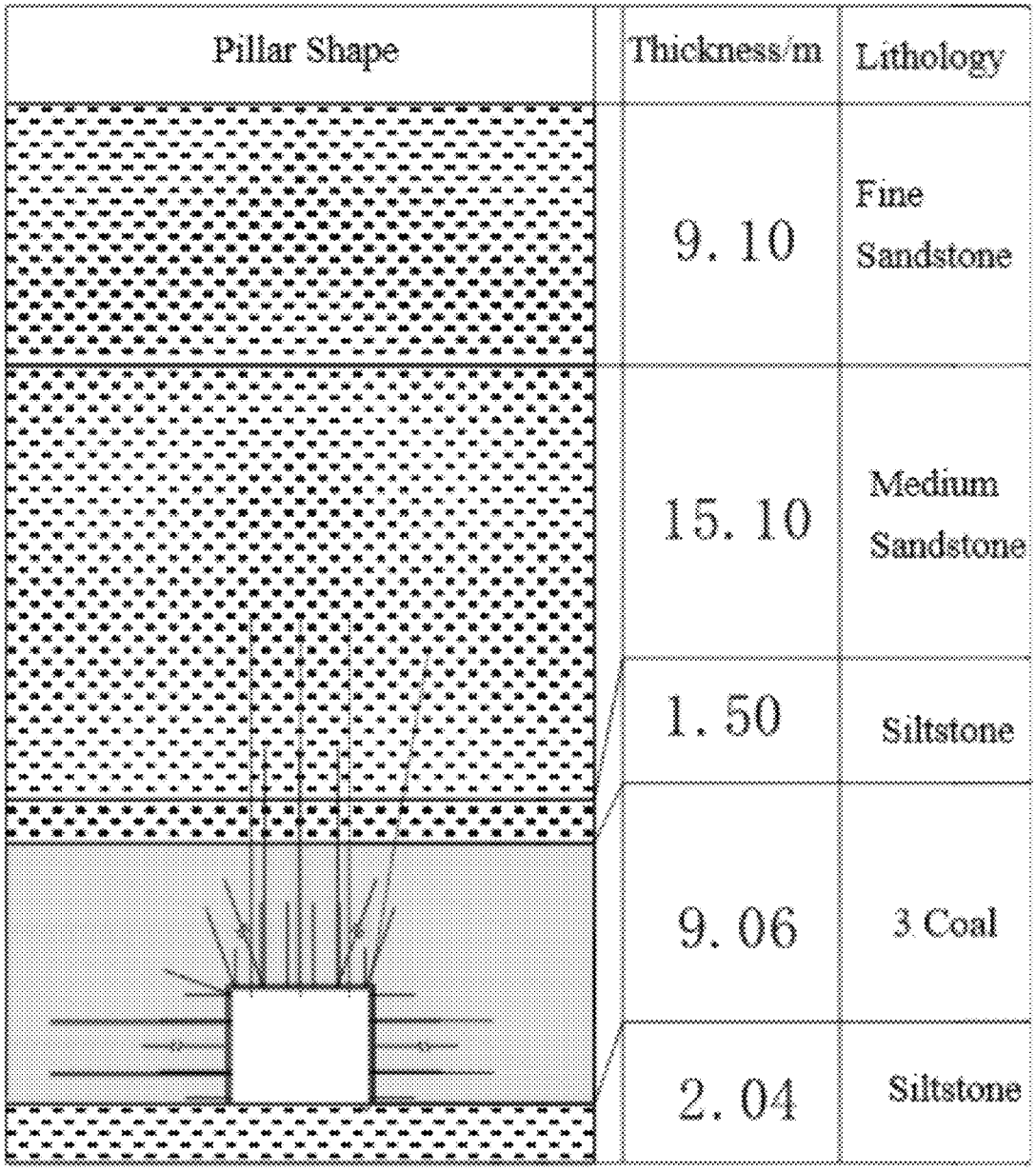
FIG. 1 is a schematic cross-sectional view of strata in an example of the present disclosure.

1. pre-splitting slit; 2. gangue retaining pillar; 3. first metal mesh; 4. flexible mold bag; 5. second metal mesh; 6. flange; 7. constant resistance anchor cable; 8. grouting anchor cable; 10. blast hole; 11. unit bracket; 12. single shed; 13. connecting rod.

DETAILED DESCRIPTION

In order let one skilled in the art better understand the solution of the present disclosure, some examples of the technical solutions of the present disclosure will be described clearly and completely with reference to the drawings of the examples in the present disclosure. It is obvious that the examples as described are only some of the examples of the present disclosure, rather than all the examples. Based on the examples in the present disclosure, all other examples obtained by one skilled in the art without involving inventive effort fall within the protection scope of the present disclosure.

It should be noted that the specification and claims of the present disclosure and the terms "first", "second", and the like in the drawings are used to distinguish similar objects and are not necessarily used to describe a particular order or sequential order. It is to be understood that the data so used are interchangeable under appropriate circumstances for the examples of the present disclosure described herein. Further, the terms "comprise", "have", and any variations thereof are intended to cover a non-exclusive inclusion, such as that a process, method, system, product, or apparatus that comprises a series of steps or elements is not necessarily limited to those steps or elements explicitly listed, but may comprise other steps or elements not explicitly listed or inherent to the process, method, product, or apparatus.

In the present disclosure, the orientational or positional relationships indicated by the terms "on", "under", "in", "within", "out", "front", "behind", and the like are based on the orientational or positional relationships shown in the drawings. These terms are used primarily to better describe the present disclosure and examples thereof, and are not used to limit that the indicated device, element, or component must have a particular orientation or be configured and operated in a particular orientation.

In addition, part of the above terms may be used to represent other meanings in addition to the orientational or positional relationship, for example, the term "on" may also be used to represent a certain attachment relationship or connection relationship in some circumstances. Specific meanings of these terms in the present disclosure may be understood by one skilled in the art in light of specific circumstances.

Further, the terms "dispose", "connect", and "fix" are to be understood broadly. For example, "connect" may be fixed connection, detachable connection, or integral construction; may be mechanical connection, or electric connection; may be direct connection or indirect connection by an intermediate medium, or may be internal connection between two devices, elements or components. Specific meanings of the above terms in the present disclosure may be understood by one skilled in the art in light of specific circumstances.

It should be noted that the examples and features in the examples of the present disclosure may be combined with each other in the case of no conflict. The present disclosure will be described in detail below with reference to FIG. 1 to FIG. 8 and in combination with the examples.

The examples of the present disclosure provide a method of no-pillar mining with gob-entry retaining adapted for fully-mechanized top coal caving in a thick coal seam, which comprises the following steps:

Step 1: reinforcing support on a roof and two sides of a roadway during tunnelling of a retained entry;

Step 2: performing roof slitting blasting in advance of a working face, with blast holes arranged in a stoping-side roadway corner line to form a pre-splitting slit;

Step 3: erecting a temporary support device and a gangue retaining device in the roadway along the retained entry;

Step 4: performing no caving within a range of a preset distance X at an end of the working face near the retained entry side in the stoping process of the working face;

Step 5: removing the temporary support device in the roadway after stoping at the working face and entry forming stabilizes, and closing the gob to complete entry retaining.

In the mining method provided in the examples, in step 2, slitting blasting of the roadway roof is more beneficial to collapse of strata in the gob, so that the strata in the slit can better fill stoping space after collapse, and the roof of the retained entry forms a short arm beam structure laterally, which avoids forming a long suspended roof in the gob, improves the stress of surrounding rock of gob-side entry retaining, that is, reduces additional load brought to the retained entry, and cuts off stress transfer to some extent; in step 4, coal caving is not performed in a certain range at the end of the working face of the retained entry side, which further ensures the filling effect of the gob on the retained entry side, effectively limits the rotary sinking of blocks of the main roof, greatly reduces the effect on the stability of the retained entry, and further increases the stability of the retained entry in combination with the reinforcing support of the roadway.

Due to the increase of mining height in the top coal caving method, caving action of the top coal, and the particularity of the roof, the roof of the retained entry is disturbed many times during working face advancing, top coal caving and reuse of the retained entry, which makes it easier to produce various cracks, leading to decrease of the roof strength and affecting the roadway stability. Although conventional reinforcing support can realize yielding deformation, it cannot improve self-strength of cracked rock mass. In some examples, in the process of reinforcing support of the roof and two sides of the roadway in step 1, a constant resistance anchor cable and a grouting anchor cable are used to reinforce support on the roof, a common anchor cable is used to reinforce support on the main side, and a grouting anchor cable and a common anchor cable are used to reinforce support on the auxiliary side. Before the secondary reuse of the retained entry, a grouting anchor cable is used to grout the cracked roof and auxiliary side, so as to improve strength of the roof and auxiliary side coal.

Slitting blasting is easy to damage the coal roof. The roof of the retained entry in general mining conditions is mostly mudstone or siltstone, while the retained entry roof in top coal caving in a thick coal seam is coal. Compared with rock, the strength of coal is lower, and joint cracks are more developed. Under the condition of the same blasting parameters, the coal roof is more likely to be damaged, thus affecting the roadway stability. To minimize the damage of slitting blasting to the coal roof, in some examples, the blasting parameter design method of "long seal mud+degressive charge" is preferably used, a lute length of the blast hole is no less than 3 m, the number of explosive rolls in the blast hole gradually decreases from inside to outside, and the explosive roll is not placed in the shaped charge pipe next to the lute. Preferably, the blast holes are deflected to the gob by 10° to 20°, the depth of the blast holes is 10 m to 14 m, the distance between the blast holes is 450 mm to 550 mm, and the distance between the blast hole and the roadway main side is 150 mm to 250 mm.

The temporary support device is used for temporary reinforcing support in the roadway, which can provide large roof cutting resistance at the initial stage, limit rapid sinking of the roof at the initial stage of entry retaining, and resist strong mining pressure. In some examples, the step of erecting a temporary support device in the roadway along the retained entry comprises: supporting with double-row unit brackets in a range of 50 m in front of the working surface, and retreat space of 2 m is reserved between the unit brackets. Single-row unit brackets and single sheds are used jointly for support in a range of 250 m behind a mining support, a row of unit brackets is arranged on the pre-splitting slit side, and two rows of single sheds are arranged on the non-slitting side. Single-row unit brackets and single sheds are used jointly for support in a range of 250 m behind a mining support, a row of unit brackets is arranged on the pre-splitting slit side, and two rows of single sheds are arranged on the non-slitting side.

The technical solution provided in the present disclosure can well adapt to the stress characteristics, surrounding rock characteristics, and gob characteristics in the conditions of fully mechanized top coal caving in a thick coal seam. The technology mainly comprises a roof pre-splitting slit technology, a roadway reinforcing support technology, a roadway temporary support technology, and a technology of gangue retaining behind a mining support. Taking a working face of fully-mechanized top coal caving in a coal seam of 9 m (mining height of 4 m and caving height of 5 m) as an example, the technical solution is described in detail. The strata structure is as shown in FIG. 1. The actual thickness of the coal seam is 9.06 m, overlying strata of the coal seam are siltstone with a thickness of 1.50 m, medium sandstone with a thickness of 15.10 m, and fine sandstone with a thickness of 9.10 m, and a bottom plate of the coal seam is siltstone with a thickness of 2.04 m. The method of no-pillar mining with gob-entry retaining adapted for fully-mechanized top coal caving in the thick coal seam as shown in FIG. 1 is as described below.

Step 1: reinforcing support on a roof and two sides of a roadway during tunnelling of a retained entry.

Figure 3:
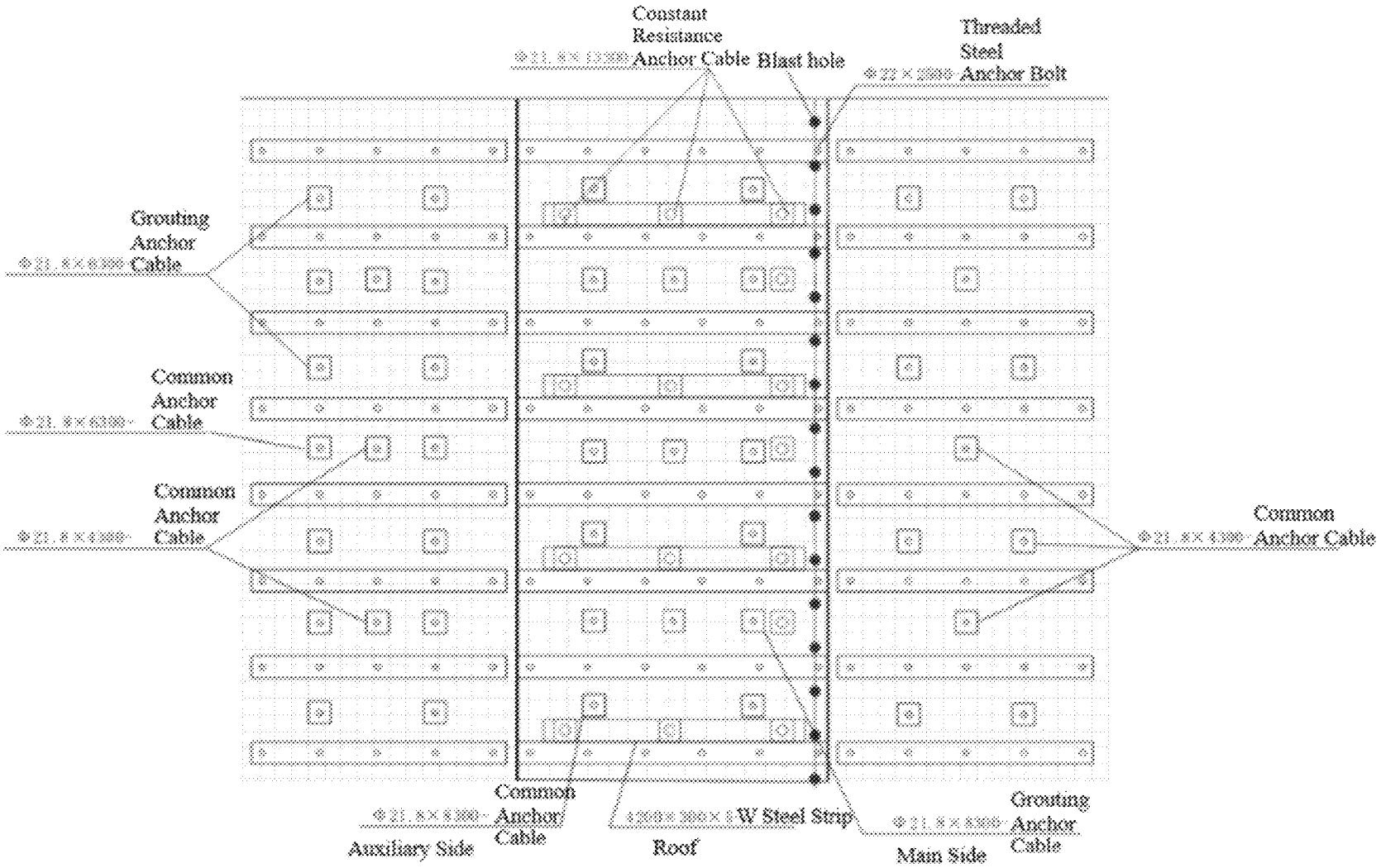
FIG. 3 is an expanded view of a roadway reinforcing support plane in a mining method provided in the present disclosure.
Figure 4:
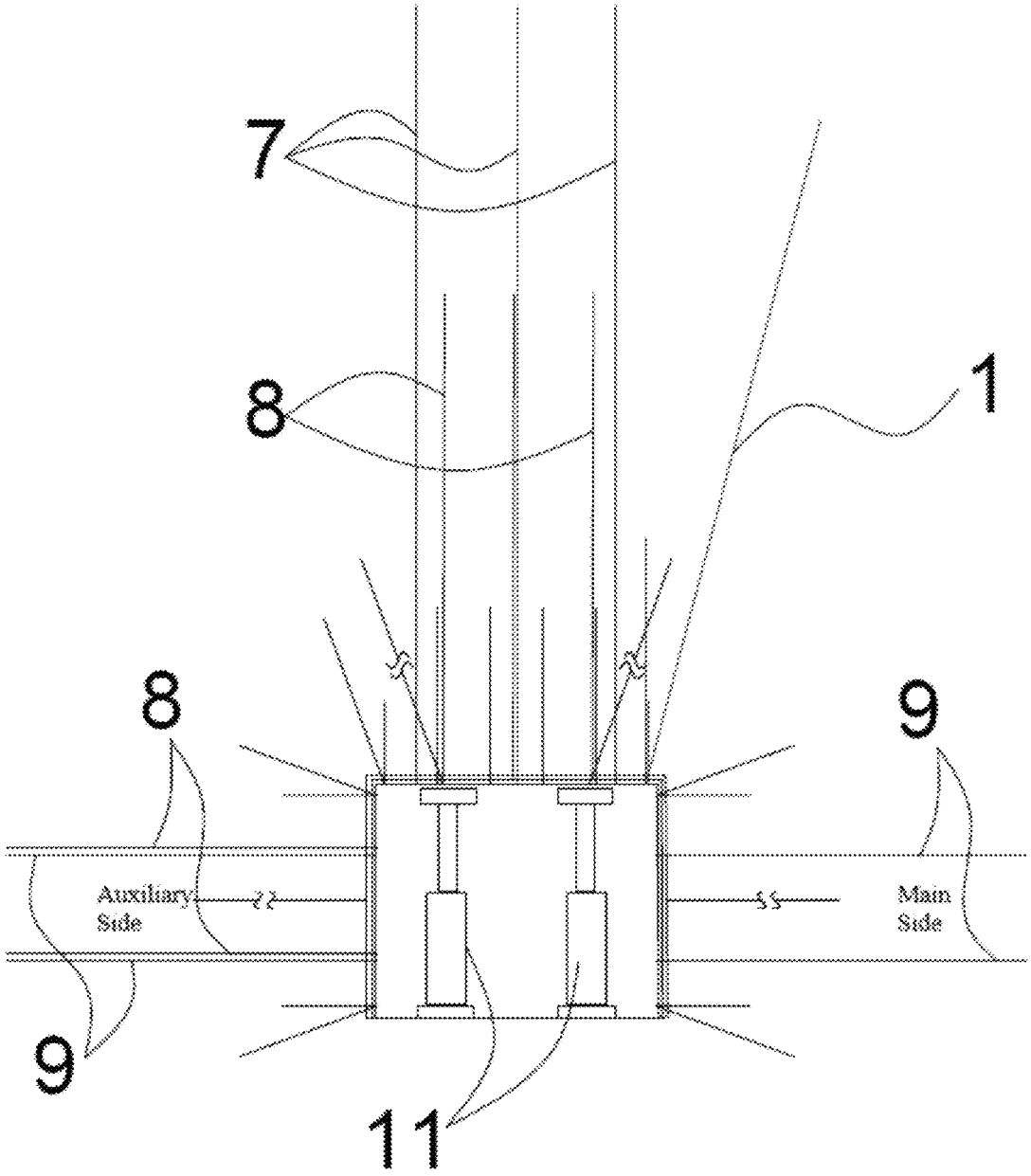
FIG. 4 is a schematic view of an advanced area support design in a mining method provided in the present disclosure.

As shown in FIGS. 3 and 4, the roof is reinforced with a constant resistance anchor cable 7 and a grouting anchor cable 8. Through calculation, it is designed that the length of constant resistance anchor cable support is 13.3 m, the diameter of the anchor cable is 21.8 mm, and the anchor cables are arranged perpendicular to the roof and in three columns in total. The first column of constant resistance anchor cables is 600 mm away from the main side of the retained entry with an array pitch of 1000 mm; the second column is arranged on the middle line of the roadway, with an array pitch of 2000 mm; the third column is arranged 600 mm away from the auxiliary side of the roadway, with an array pitch of 2000 mm. Adjacent anchor cables of the first column of constant resistance anchor cables are connected with a W steel strip (the W steel strip is parallel to the roadway). The roof grouting anchor cable 8 has a length of 8.3 m, a diameter of 21.8 mm. There are three grouting anchor cables in each row, with an array pitch of 1250 mm×2000 mm, and each row is connected by channel steel.

As shown in FIG. 3 and FIG. 4, a normal anchor cable 9 with a length of 4.3 m is added to the main side, and the normal anchor cable has a selected diameter of 21.8 mm and an array pitch of 1800 mm×2000 mm. The grouting anchor cable 8 with a length of 6.3 m and the ordinary anchor cable with a length of 6.3 m are added to the auxiliary side. The grouting anchor cable has a selected diameter of 21.8 mm and a selected array pitch of 1800 mm×2000 mm; the normal anchor cable has a selected diameter of 21.8 mm and a selected array pitch of 1800 mm×2000 mm, with 2 cables in each row.

Of course, the reinforcing support way of the roof and two sides is not limited to the above specific forms, but can be specifically designed according to the strata structure and mining parameters.

Step 2: performing roof slitting blasting in advance of a working face, with blast holes 10 arranged in a stoping-side roadway corner line to form a pre-splitting slit 1.

Figure 2:
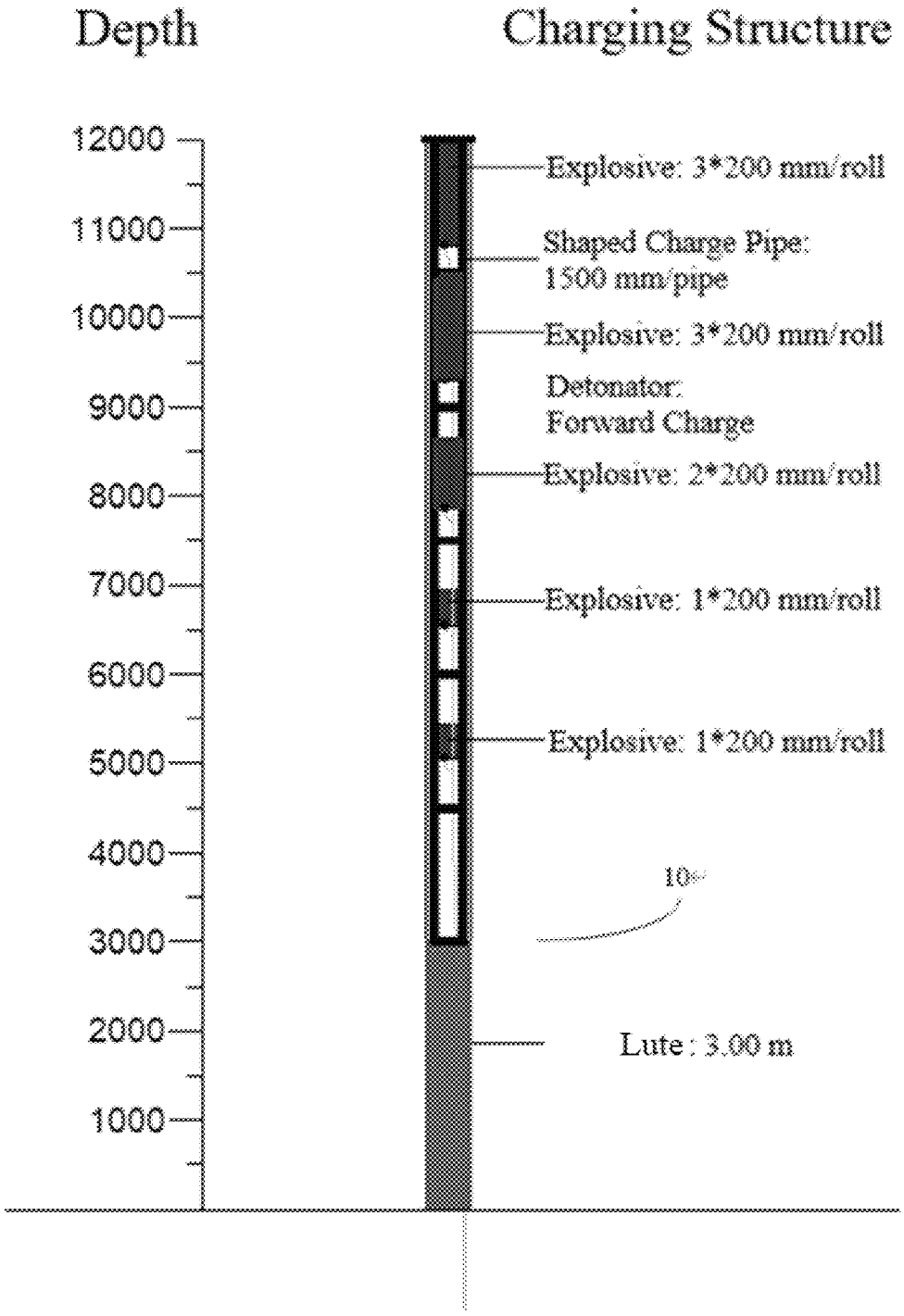
FIG. 2 is a schematic view of a charge means in a blast hole in a mining method provided in the present disclosure.

As shown in FIG. 3, it is designed by calculation that a slitting hole depth is 12 m, the distance between the blast holes 10 is 500 mm, the distance between the opening position of blast holes 10 on the roadway roof and the roadway main side is 200 mm, and the blast holes deflect to a gob by 10°. To minimize the damage of slitting blasting to the coal roof, a blasting parameter design method of "long lute+degressive charge" is used, as shown in FIG. 2, a lute length of the blast hole is 3 m, six shaped charge pipes with a length of 1.5 m are placed, the number of explosive rolls in the hole gradually decreases from inside to outside, and the explosive roll is not placed in the shaped charge pipe next to the lute. Finally, a charging structure is determined to be 3+3+2+1+1+0, that is, the number of the explosive rolls from inside to outside is 3, 3, 2, 1, 1 and 0 in turn.

Step 3: erecting a temporary support device and a gangue retaining device in the roadway along the retained entry.

Figure 5:
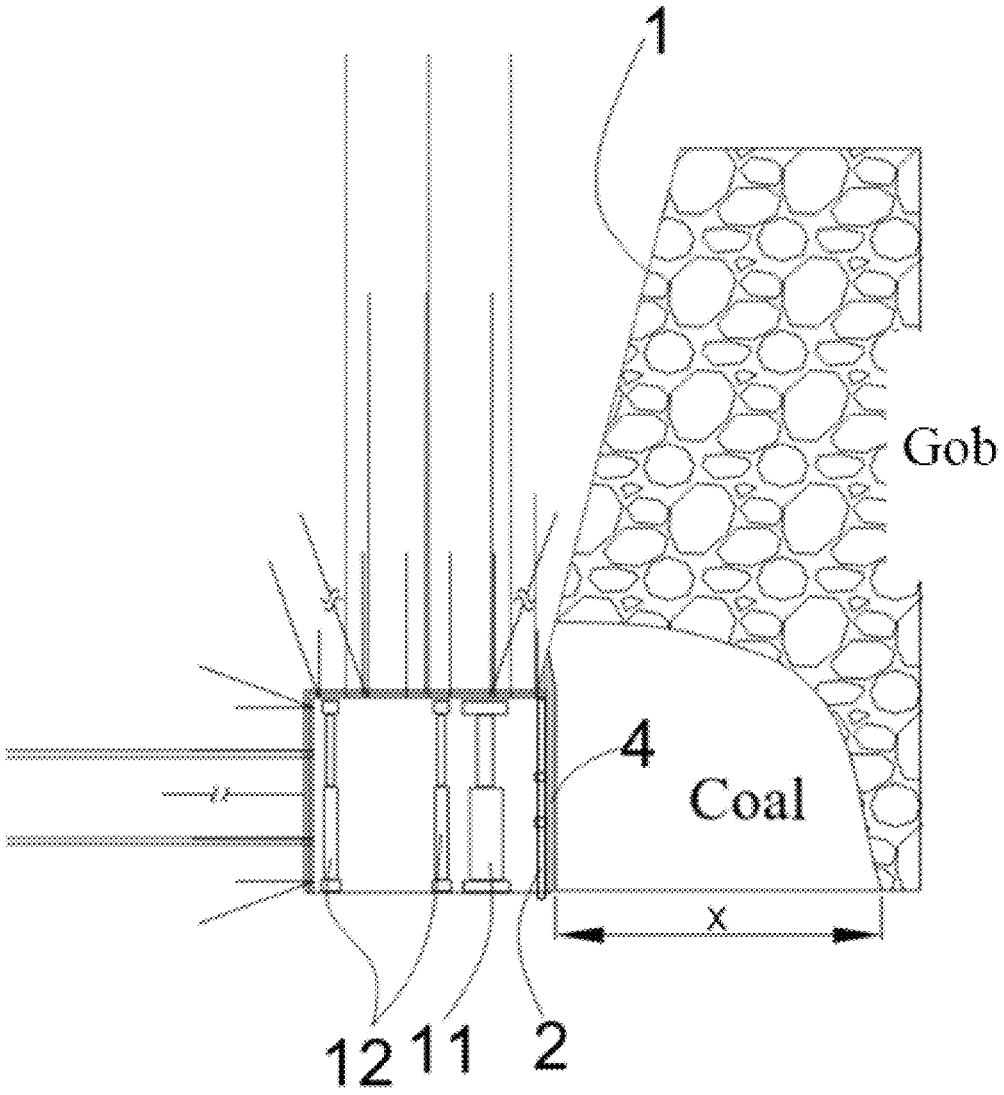
FIG. 5 is a schematic view of a temporary support design behind a mining support in a mining method provided in the present disclosure.

As shown in FIG. 4, double-row unit brackets 11 are used for supporting in an advanced support area (50 m in front of the working surface), and retreat space of 2 m is reserved between the unit brackets 11. As shown in FIG. 5, single-row unit brackets 11 and single sheds 12 are used jointly for support in a temporary support area behind the mining support (250 m behind the mining support). Specifically, a row of unit brackets 11 is arranged on the side of the pre-splitting slit 1, and two rows of single sheds 12 are arranged on the non-slitting side. The first row of single sheds 12 is 500 mm away from the auxiliary side, and the second row of single sheds is 2000 mm away from the first row of single sheds. The single sheds are arranged along the roadway with a hinged roof beam of 1 m.

Step 4: performing no caving within a preset distance X at an end of the working face near the retained entry side in the stoping process of the working face. The purpose of this step is that: by performing no caving in a certain range at the end of the working face on the retained entry side, the top coal not caved and overlying strata naturally collapse along the pre-splitting slit 1, and the collapsed roof and strata are crushed and its accumulated volume expands, finally realizing natural roof connection with the roof, supporting the roof, limiting rotary sinking of the main roof, reducing stress disturbance, and playing a role of small coal pillars beside the roadway. Further, the mining method of top coal caving in a thick coal seam is transformed into a traditional 110 method of gob-side entry retaining of a medium-thick coal seam, and finally form a retained entry side gob with ensured filling and support effects. Specifically, coal caving is not performed within the preset distance X at an end of the working face near the retained entry side. The inventor has concluded through experimental simulation and the actual situation on site that the preset distance X is closely related to the horizontal projection length of the pre-splitting slit and a range of the roadway side plastic zone. When the preset distance X uses the following calculation formula, better stability of the retained entry can be obtained. The specific calculation formula is:

$$X = H_{slit} \cdot \sin\theta + \frac{mA}{2\tan\varphi_0}\ln\left[\frac{K\gamma H + \frac{c_0}{\tan\varphi_0}}{\frac{c_0}{\tan\varphi_0} + \frac{p_z}{A}}\right]$$

wherein $H_{slit}$ is slitting depth in units of m, $H_{slit}$=12 m in the example of the present disclosure;

θ is an angle between the slitting line and the vertical direction in units of °, that is, a deflection angle of the blast hole to the gob in the example, and θ=10°;

m is a coal seam thickness in units of m, and m=9.06 m in the example;

A is a side pressure coefficient that is dimensionless;

$\varphi_0$ is an internal friction angle at a coal seam interface in units of °;

$c_0$ is a cohesive force at the coal seam interface in units of MPa;

K is a stress concentration coefficient that is dimensionless;

γ is an average volume weight of overlying strata in units of $N/m^3$;

H is a roadway burial depth in units of m, and H=34.76 m in the example; and $p_z$ is a support resistance of a coal side on the roadway stoping side in units of MPa.

In the parameters described above, A, $\varphi_0$, $c_0$, K, γ, H, and $p_z$ are obtained according to current mining conditions and tests.

The above formula can well solve an issue that it is difficult to determine a range of performing no caving, and does not lead to a too large range of performing no caving and waste of coal resources on the premise of ensuring good support on the roof. It should be noted that since a distance of performing no caving can only be controlled by a mining bracket, in the actual operation process, X is calculated by the above formula, divided by the length of a single mining bracket, and then rounded up to obtain the number of brackets without coal caving at the roadway end.

Figure 8:
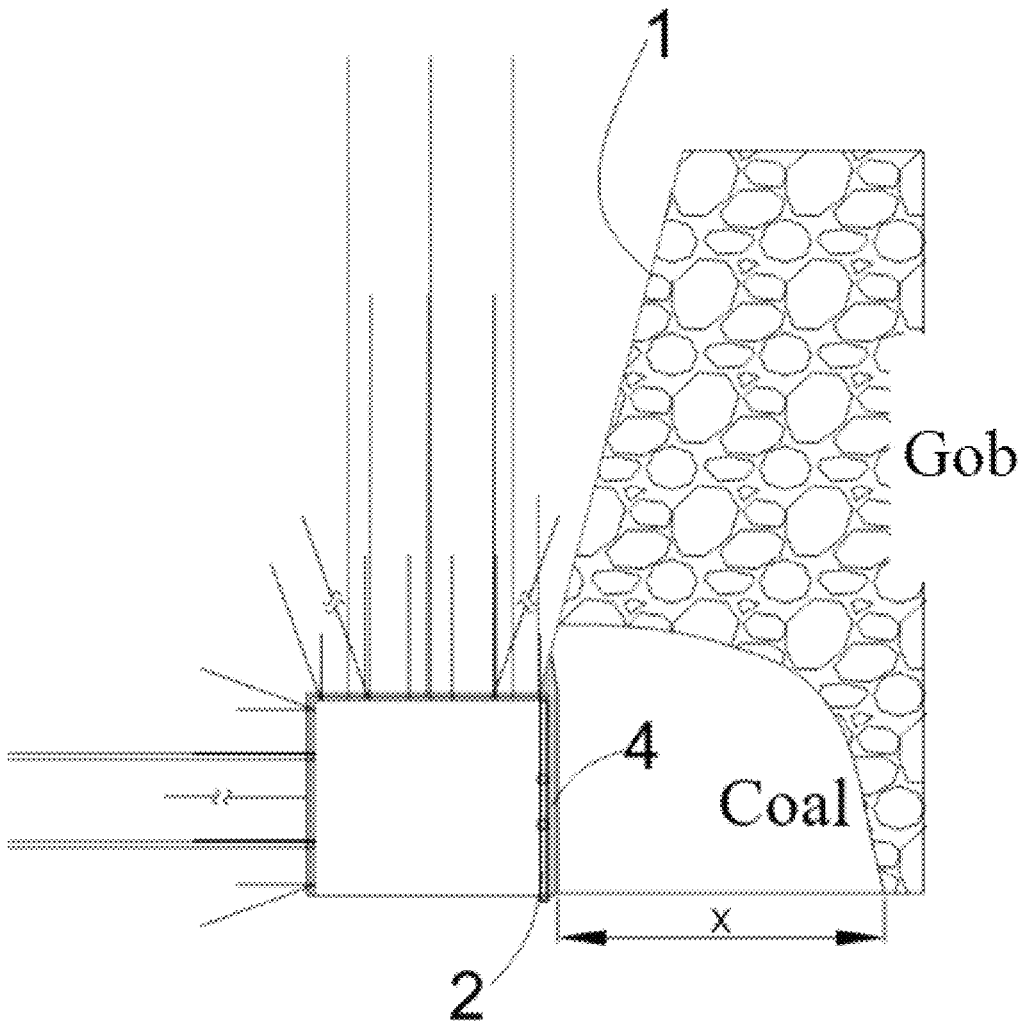
FIG. 8 is a gob closed effect view after entry forming stabilizes in a mining method provided in the present disclosure.

Step 5: removing the temporary support device in the roadway after stoping at the working face and entry forming stabilizes, and closing the gob to complete entry retaining, as shown in FIG. 8.

Figure 6:
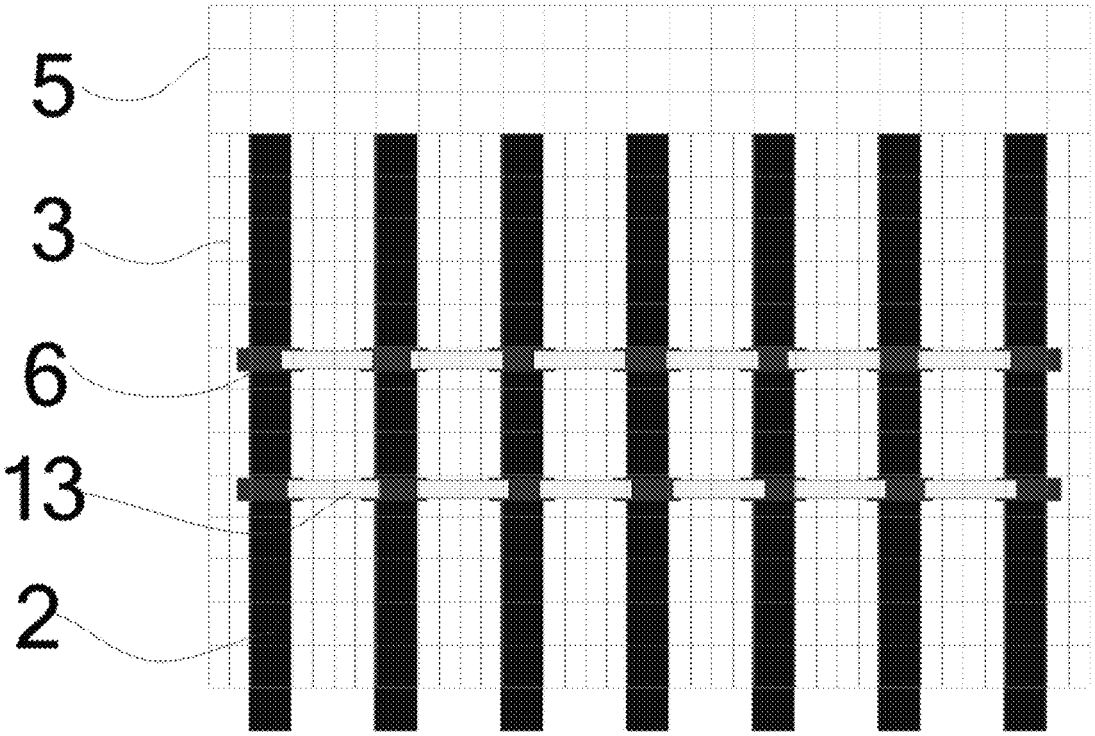
FIG. 6 is a structural schematic view of a gangue retaining device in a mining method provided in the present disclosure.
Figure 7:
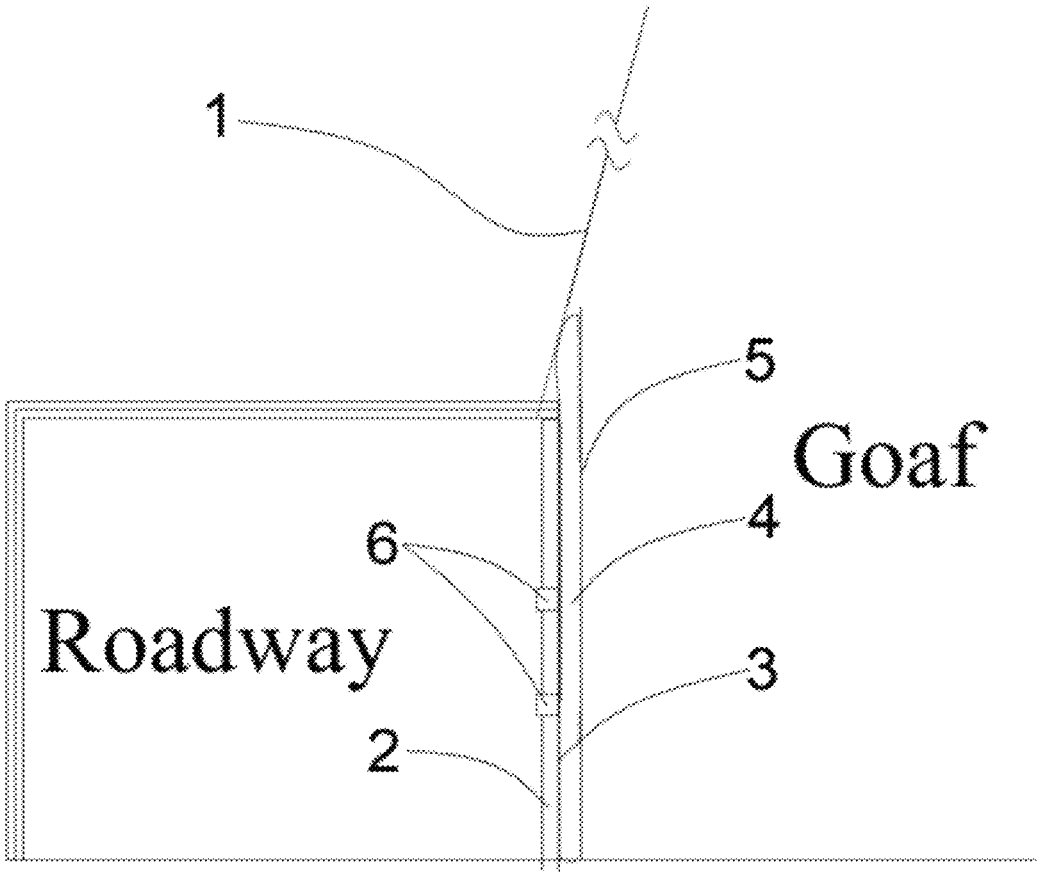
FIG. 7 is an effect view after an elastic quick-setting material is poured into a flexible mold bag in a mining method provided in the present disclosure.

The existing gangue retaining technology does not meet gob closure requirements, and in the present disclosure, caving is not performed in a certain range from the end, and loose coal formed by coal collapse above the bracket is easy to cause spontaneous combustion, so gob closure is more important. In the prior art, the purpose of isolating the gob is achieved by erecting a gangue retaining and side support structure and then spraying, and the gob is closed often by spraying chemical materials in the process of entry retaining. Although the formed chemical spray layer has certain deformation ability, the deformation ability is weak, and deformation and cracking still occur under the action of strong dynamic pressure disturbance, thereby losing the function of closing the gob and causing a great potential safety hazard. Because there is some residual coal in the gob, which is easy to cause spontaneous combustion, it is required that the gangue retaining structure can well ensure closeness of the gob while bearing a plurality of times of disturbance and slipping yielding. Although the conventional gangue retaining technology can achieve a certain degree of slipping yielding, it is not ideal for a gob closure effect and cannot meet gob closure requirements of the top coal caving. In order to solve the above issue, in some examples, as shown in FIGS. 5 to 7, the gangue retaining device comprises a gangue retaining pillar 2, a double layer metal mesh comprising a first metal mesh 3 and a second metal mesh 5, and a flexible mold bag 4. The double layer metal mesh is fixed to one side of the gangue retaining pillar 2 near the gob, and the flexible mold bag 4 is laid within the double layer metal mesh. After entry forming stabilizes, the flexible mold bag 4 is filled with a quick-setting elastic material to close the gob. Specifically, the gangue retaining pillar 2 is disposed close to the gob side behind the stoping working face, the first metal mesh 3 is secured on a side of the gangue retaining pillar 2 close to the gob, the flexible mold bag 4 is laid on a side of the first metal mesh 3 close to the gob, and the second metal mesh 5 is laid on a side of the flexible mold bag 4 close to the gob. The flexible mold bag 4 is laid forwardly along with advance of the mining bracket of the working surface, which can timely close the mined part; and the quick-setting elastic material is poured into the laid flexible mold bag 4, and the quick-setting elastic material slowly solidifies in the flexible mold bag for closing the gangue side.

In the above examples, a directional pre-splitting blasting slitting technology is used in combination with constant resistance anchor cable support to weaken stress transfer of the roof, and a support coal pillar is formed by performing no caving in a certain range of the end, which increases dynamic pressure resistance ability of the roadway; meanwhile, the flexible mold bag and quick-setting elastic material which can be greatly deformed are combined with the gangue retaining structure, so as to achieve the purpose of ensuring good gob closure effect at the same time of yielding deformation. As shown in the drawings, with the advance of the working face, under the action of mine pressure, the coal not caved and immediate roof rock above the support begin to collapse, impact, and press the second metal mesh 5, the first metal mesh 3, the gangue retaining pillar 2, and the flexible mold bag 4. In the process of pressing, the metal mesh and the gangue retaining pillar 2 are deformed to some extent. However, due to the particularity of the quick-setting elastic material in the flexible mold bag 4 and the particularity of the gangue retaining structure, the flexible mold bag 4 can still achieve a good closure effect despite some deformation. The finally collapsed gangue is compacted to form a gangue wall. Under the clamping action of the gangue wall, the gangue retaining pillar 2, the second metal mesh 5, and the first metal mesh 3, the closed structure of the gob is finally stable, thereby closing the gob.

In some examples, as shown in FIG. 6, the height of the second metal mesh 5 and the flexible mold bag 4 exceeds the roadway height, the excess size is preferably 800 mm to 1200 mm, the excess parts extend above the gob, the height of the first metal mesh 3 is the same as the roadway height, the first metal mesh 3, the second metal mesh 5, and the gangue retaining pillar 2 form a stable monolithic structure. Specifically, the second metal mesh 5 is laid after the flexible mold bag 4 is laid, the second metal mesh 5 can be bundled with the first metal mesh 3 of the roof part, the two metal meshes are spaced by a distance (consistent with the thickness of the flexible mold bag that is designed), and fixed with metal wire such as iron wire. Preferably, the distance between the first metal mesh 3 and the second metal mesh 5 is 10 mm to 150 mm, that is, the finally formed quick-setting elastic material has a thickness range of 10 mm to 150 mm under solidification. As the structure does not need to provide a support function and does not require strength, a small thickness can be designed to accommodate large deformation. After laying the double layer metal mesh and the flexible mold bag 4, the first metal mesh is bundled and fixed to the gangue retaining pillar 2 to maintain stability of the overall structure. The height of the second metal mesh 5 and the flexible mold bag 4 exceeds the roadway height for achieving sealing between the flexible mold bag and the roof, and the excess flexible mold bag is initially laid at the slit under the support of the second metal mesh, and will eventually be pressed at the slit by the collapsed gangue, forming sealing with the roof. Preferably, the first metal mesh and the second metal mesh are both a steel bar mesh.

It should be noted that the quick-setting elastic material comprises but is not limited to high water filling material, foam adhesive, and quick-setting rubber. It is required that the quick-setting elastic material has certain elasticity after solidification and can bear a certain amount of deformation. For example, the high-water filling material can be low elastic modulus and low ash concrete disclosed in an invention patent with a publication number of CN1257846A, the foam adhesive can be polyurethane foam glue, and the quick-setting rubber can be spraying quick-setting liquid rubber.

In some examples, a plurality of flexible mold bags 4 extend by overlapping in turn along the roadway direction, and the overlapping width of two adjacent flexible mold bags 4 is 150 mm to 250 mm. Thus, the size of the existing flexible mold bag can be fully used to meet the requirement for long-distance gangue retaining sealing in the roadway. The overlapping width of 150 mm to 250 mm can fully ensure sealing of the overlap and avoid leakage at the overlap of two flexible mold bags. The design length of each flexible mold bag is preferably a distance of each advance of the mining bracket, which can realize mining and laying of the flexible mold bag behind the mining support and close the gob more conveniently and quickly.

In some examples, as shown in FIG. 6, the gangue retaining pillar 2 comprises a yieldably overlapping upper and lower U-shaped steels, the two U-shaped steels are connected by two flanges 6, the U-shaped steels are arranged at 500 mm intervals along the roadway direction, embedded in the bottom plate by not less than 200 mm, and is fixed with a wood wedge so as to hold the U-shaped steels in the same straight line, and then the first metal mesh is laid. As a gangue retaining and side support structure, the gangue retaining pillar 2 can generate slipping deformation under dynamic pressure disturbance using two U-shaped steels to absorb energy, and has a good yielding function. The constant resistance anchor cable 1 of the roof cooperates with the gangue retaining pillar 2 of the structure, which can further dampen stress concentration of the roof or the side caused by the dynamic pressure disturbance, enhances dynamic pressure resistance ability of the roadway, and avoids failure of the roof anchor cable and the main side support structure, thereby ensuring an entry forming effect. Preferably, in the U-shaped steel, upper and lower 36U yieldably overlap and are connected by two flanges, the upper and lower edges of which are 50 mm from the overlapping end of the U-shaped steel with an overlapping length of greater than 1 m. Adjacent U-shaped steels are connected by the connecting rod 13 to realize stability of the gangue retaining pillar.

In some examples, the quick-setting elastic material is poured into the flexible mold bag 4 through a grouting hole that is reserved on the flexible mold bag 4, and after the pouring is completed, it is required to fill the quick-setting elastic material into the flexible mold bag 4 evenly. Manual squeeze or the like needs to be adopted to assist flow of high-water material in some corners and edges where the quick-setting elastic material cannot easily flow in, so as to ensure the filling effect. Meanwhile, it is required to pay particular attention to whether there is a gap caused by dislocation at the overlap of the flexible mold bag, and deal with the issue in time.

The technical solutions provided in the examples of the present disclosure can ensure the good gob closure effect while large deformation occurs. Due to the particularity of the quick-setting elastic material in the flexible mold bag, it can adapt to the large deformation of the gangue retaining structure without local cracking, peeling, or the like, and can still maintain good closure effects under a plurality of times of dynamic pressure disturbance during entry retaining and reuse thereof without local air leakage. Meanwhile, under pressing of gangue, the quick-setting elastic material in the flexible mold bag are deformed under pressing of the gangue wall and the metal mesh, and the quick-setting elastic material is deformed from the place with higher pressure to the place with lower pressure, which can better fill the gap between the gangue wall and the metal mesh, thereby well ensuring the gob closure effect.

The method of no-pillar mining with gob-entry retaining adapted for fully-mechanized top coal caving in a thick coal seam of the present disclosure mainly adopts a special charging structure to reduce damage to a weak roof; adopts a combination of a constant resistance anchor cable and a grouting anchor cable to improve strength of roadway surrounding rock before secondary reuse; does not perform caving at an end of a working face on a retained entry side to ensure a support effect for the roof under conditions of large mining height; and combines the gangue retaining structure with the flexible mold bag structure to ensure closeness of the gob while retaining gangue. Its technical advantages are as follows:

(1) Damage to the roof can be minimized while ensuring the slitting effect. The structure of "long lute+degressive charge" described above can minimize damage to the roof while ensuring the slitting effect.

(2) The strength of surrounding rock deformed by dynamic pressure disturbance of the roadway can be improved. By combining the constant resistance anchor cable with the grouting anchor cable, parts of roadway surrounding rock with large deformation and cracks are grouted, so as to improve strength of the surrounding rock and ensure the entry retaining effect and stability of the roadway during secondary reuse of the retained entry.

(3) Good gob closing effect can be achieved. The support effect for the roof is ensured by performing no caving in the preset range at the end of the working face on the retained entry side. At the same time, the gangue retaining and flexible mold structure described above can realize yielding deformation synchronous with the roadway, and can ensure the gob closing effect while yielding, thus preventing spontaneous combustion of the gob.

(4) Good entry retaining effect can be achieved. This technology can well realize the gob-side entry forming under the conditions of top coal caving in a thick coal seam, and the roadway deformation amount is small, stability of the surrounding rock is good, which can well meet the reuse requirements.

The corresponding arrangement positions and connection relationships of structures not mentioned in the present disclosure and a mutual sequence and control parameters of steps not mentioned may refer to similar devices and methods in the prior art, and the connection relationship, operation and working principle of the structures not mentioned are known to one skilled in the art, and will not be described in detail here.

Part of the examples in the specification are described in a progressive manner, each mainly illustrating differences from other examples, and the same or similar parts between which can refer to each other.

The above are only specific embodiments of the present disclosure to enable one skilled in the art to understand or implement the disclosure. Various modifications to these examples will be obvious to one skilled in the art, and the general principles defined herein can be implemented in other examples without departing from the spirit or scope of the present disclosure. Therefore, the present disclosure will not be limited to the examples shown in the present disclosure, but should conform to the widest scope consistent with the principles and novel features of the present disclosure.

What is claimed is:

1. A method of no-pillar mining with gob-entry retaining adapted for fully-mechanized top coal caving in a thick coal seam, comprising the following steps:

reinforcing support on a roof and two sides of a roadway during tunnelling of a retained entry;

performing roof slitting blasting in advance of a working face, with blast holes arranged in a stoping-side roadway corner line area to form a pre-splitting slit;

erecting a temporary support device and a gangue retaining device in the roadway along the retained entry;

performing no caving within a preset distance X at an end of the working face near the retained entry side in the stoping process of the working face, wherein a calculation formula of the preset distance X is $$X = H_{slit} \cdot \sin\theta + \frac{mA}{2\tan\varphi_0}\ln\left[\frac{K\gamma H + \frac{c_0}{\tan\varphi_0}}{\frac{c_0}{\tan\varphi_0} + \frac{p_z}{A}}\right]$$

wherein $H_{slit}$ is slitting depth in units of m, $\theta$ is an angle between a slitting line and a vertical direction in units of °, m is a coal seam thickness in units of m, A is a side pressure coefficient, $\varphi_0$ is an internal friction angle at a coal seam interface in units of °, $c_0$ is a cohesive force at the coal seam interface in units of MPa, K is a stress concentration coefficient, $\gamma$ is an average volume weight of overlying strata in units of $N/m^3$;

H is a roadway burial depth in units of m, and $p_z$ is a support resistance of a coal side on the roadway stoping side in units of MPa; and removing the temporary support device in the roadway after stoping at the working face and entry forming stabilizes, and closing the gob to complete entry retaining.

2. The method of no-pillar mining with gob entry retaining adapted for fully-mechanized top coal caving in a thick coal seam of claim 1, wherein the gangue retaining device comprises a gangue retaining pillar, a double layer metal mesh, and a flexible mold bag, the double layer metal mesh is fixed to one side of the gangue retaining pillar near the gob, and the flexible mold bag is laid within the double layer metal mesh, and after entry forming stabilizes, the flexible mold bag is filled with a quick-setting elastic material to close the gob.

3. The method of no-pillar mining with gob-entry retaining adapted for fully-mechanized top coal caving in a thick coal seam of claim 2, wherein the gangue retaining pillar comprises two yieldably overlapping upper and lower U-shaped steels, the two U-shaped steels are connected by two flanges, the U-shaped steels are arranged at 500 mm intervals along a roadway direction and embedded in a bottom plate by no less than 200 mm.

4. The method of no-pillar mining with gob-entry retaining adapted for fully-mechanized top coal caving in a thick coal seam of claim 1, wherein in a step of reinforcing support of the roof and two sides of the roadway, a constant resistance anchor cable and a grouting anchor cable are used to reinforce support on the roof, a common anchor cable is used to reinforce support on a main side, and the grouting anchor cable and the common anchor cable are used to reinforce support on an auxiliary side.

5. The method of no-pillar mining with gob-entry retaining adapted for fully-mechanized top coal caving in a thick coal seam of claim 4, wherein before secondary reuse of the retained entry, the grouting anchor cable is used to grout the cracked roof and auxiliary side, so as to improve strength of the roof and auxiliary side coal.

6. The method of no-pillar mining with gob-entry retaining adapted for fully-mechanized top coal caving in a thick coal seam of claim 1, wherein the blast holes are deflected to the gob by 10° to 20°, a depth of the blast holes is 10 m to 14 m, a distance between the blast holes is 450 mm to 550 mm, and a distance between the blast hole and the roadway main side is 150 mm to 250 mm.

7. The method of no-pillar mining with gob-entry retaining adapted for fully-mechanized top coal caving in a thick coal seam of claim 1, wherein a lute length of the blast hole is no less than 3 m, a number of explosive rolls in the blast hole gradually decreases from inside to outside, and the explosive roll is not placed in a shaped charge pipe next to the lute.

8. The method of no-pillar mining with gob-entry retaining adapted for fully-mechanized top coal caving in a thick coal seam of claim 1, wherein a step of erecting the temporary support device in the roadway along the retained entry comprises: supporting with double-row unit brackets in a range of 50 m in front of the working surface, and a retreat space of 2 m is reserved between the unit brackets.

9. The method of no-pillar mining with gob-entry retaining adapted for fully-mechanized top coal caving in a thick coal seam of claim 8, wherein single-row unit brackets and single sheds are used jointly for support in a range of 250 m behind a mining support, a row of unit brackets is arranged on a pre-splitting slit side, and two rows of single sheds are arranged on a non-slitting side.

* * * * *